United States Patent [19]

Fender et al.

[11] Patent Number: 5,023,661

[45] Date of Patent: Jun. 11, 1991

[54] PRECHARGING OF THE X-RAY PHOTORECEPTOR TO ELIMINATE THE FATIGUE ARTIFACT

[75] Inventors: William D. Fender, Pasadena; Lothar S. Jeromin, Sierra Madre, both of Calif.

[73] Assignee: Xerox Corporation, Stamford, Conn.

[21] Appl. No.: 335,305

[22] Filed: Apr. 10, 1989

[51] Int. Cl.[5] ..... G03G 21/00

[52] U.S. Cl. ..... 355/210; 355/211; 355/219

[58] Field of Search ..... 355/214, 210, 211, 219, 355/228, 229; 378/28-33; 361/212, 213, 214

[56] References Cited

U.S. PATENT DOCUMENTS

| | | | |
|---|---|---|---|
| 3,040,621 | 6/1962 | Crumrine | 355/211 |
| 3,650,620 | 3/1972 | Hoyt, III | 378/32 X |
| 3,914,609 | 10/1975 | Jeromin | 378/28 X |
| 4,118,116 | 10/1978 | Koontz et al. | 378/28 X |
| 4,259,003 | 3/1981 | Maugal et al. | 355/210 |
| 4,262,075 | 4/1981 | Noda et al. | 355/210 X |
| 4,432,631 | 2/1984 | Bacon et al. | 355/225 |
| 4,448,512 | 5/1984 | Bean | 355/214 X |
| 4,462,679 | 7/1984 | Itaya | 355/214 X |
| 4,474,455 | 10/1984 | Hirakura et al. | 355/229 X |
| 4,529,292 | 7/1985 | Ohseto | 355/211 X |
| 4,538,900 | 9/1985 | Lutus et al. | 355/214 X |
| 4,583,489 | 4/1986 | Thourson et al. | 118/653 |
| 4,621,920 | 11/1986 | Takahashi | 355/210 |
| 4,624,544 | 11/1986 | Jeromin | 378/28 X |
| 4,693,593 | 9/1987 | Gerger | 355/214 X |
| 4,757,345 | 7/1988 | Ohashi et al. | 355/219 |

FOREIGN PATENT DOCUMENTS

| | | | |
|---|---|---|---|
| 0141660 | 9/1982 | Japan | 355/219 |

OTHER PUBLICATIONS

Materials Evaluation, vol. 29, No. 12, Dec. 1971, pp. 265-274, Robert C. McMaster and Hazen L. Hoyt, "Xeroradiography in the 1970's".

*Primary Examiner*—A. T. Grimley
*Assistant Examiner*—Matthew S. Smith
*Attorney, Agent, or Firm*—Robert E. Cunha

[57] ABSTRACT

A process modification for the development of x-ray electrophotographic images with selenium photoreceptors wherein the occurrence of a catastrophic spot producing artifact called fatigue is eliminated. The process change consists of the addition of a photoreceptor precharging step immediately after thermal relaxation and before insertion of the photoreceptor in the elevator where it may be subsequently discharged by a suitable light source within thirty seconds of the pre-charging step. The effectiveness of the pre-charging step is achieved through field assisted detrapping of interference defect site injected holes which would otherwise detrap in the image charging step, thereby producing the fatigue artifact.

2 Claims, 3 Drawing Sheets

PRECHARGING OF THE X-RAY PHOTORECEPTOR TO ELIMINATE THE FATIGUE ARTIFACT

BACKGROUND OF THE INVENTION

This invention is a process for preventing the fatigue artifact in x-ray images in the form of white spots on positive images or dark spots on negative images produced through the use of xerographic selenium plates, and more specifically is a change in the development process used in xeroradiographic x-ray imaging wherein the selenium x-ray photoreceptor is precharged positively for a period of thirty seconds or more before the standard charging step.

The xerographic process can be used to produce x-ray images by charging a xerographic plate, and then selectively discharging the plate with an x-ray beam that has passed through the body tissue under examination. The prior art includes two commonly assigned U.S. Pat. Nos. 4,583,489and 4,624,544 which describe two x-ray systems of the type in which this invention could to be used, and are included herein by reference. In a typical xerographic system, for example, after the image is transferred to the paper, the plate is cleaned, heated for a period of time in a relaxer assembly and then stored until the next use. When the plate is needed it is passed over a charging scorotron before being exposed to the x-rays.

A problem is that for some plates, repeating artifacts in the form of spots appear on the image for the second and subsequent images. It has been found that if the plate is relaxed at an elevated temperature, 2½ minutes at 130 degrees F. would be typical, and then stored in an uncharged condition for two or three hours, the next xerographic cycle will result in an image without artifacts. However, in order to maintain a minimum number of plates in the system, and to produce images at a commercial rate, it is not feasible to store each plate for a sufficient period after each use.

SUMMARY OF THE INVENTION

It has been determined that a fatigue artifact is caused by a defect in the xeroradiographic plate in the form of a selenium crystallite at the lower surface of the selenium layer of the plate, which allows positive charges, in the form of holes, to enter the selenium layer from the aluminum base during the transfer step. These holes subsequently become trapped in the selenium bulk. When the plate is recharged these positive charges detrap, and produce the artifact on the next cycle. Since it is these positive charges that must be removed from the selenium bulk before the image cycle, it has been deduced that when a positive surface potential is applied to the fatiguing photoreceptor for a period of time after thermal relaxation and before the standard scorotron recharging, that the charges can be eliminated more quickly. This is most conveniently done in the described embodiment by adding a charging corotron between the relaxer and the elevator. As the photoreceptor comes out of the relaxer it is charged to a potential of approximately 1500 volts which is retained by the photoreceptor as it rests in the elevator before reuse. The time for eliminating the trapped charges is thereby reduced to a tenth, or less, of the time it would take in an uncharged plate.

DETAILED DESCRIPTION OF THE INVENTION

FIGS. 1*a* through 1*d* explain the prior art manifestation of the fatigue artifact through a four step sequence of events. The xerographic plate shown comprises a base 13 of conducting aluminum, a central layer 12 of selenium semiconductor and an overcoating 11. A characteristic of the overcoat is that, due to the influence of vertical islands of conducting urathane in a bulk of insulating material, there can be vertical, but not horizontal, conduction.

Figure 1B:
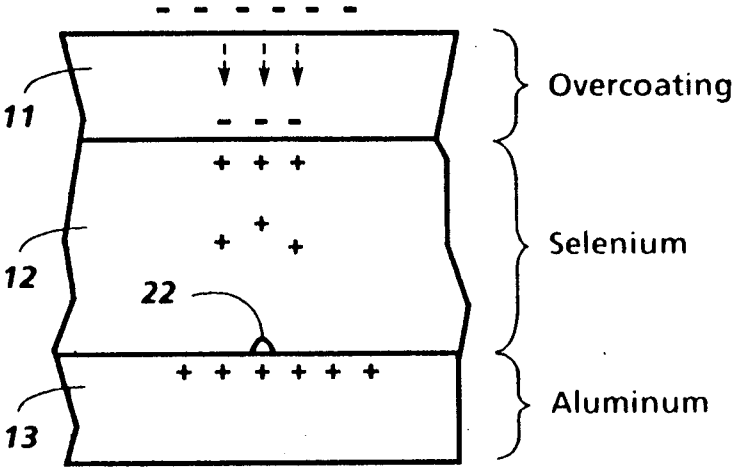
FIGS. 1*a* through 1*d* are a fatigue model describing the creation of artifacts.
Figure 1A:
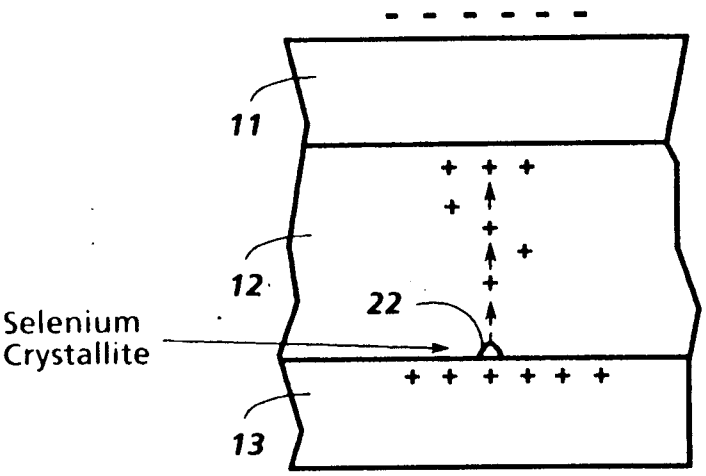

In the first step shown as FIG. 1*a*, a transfer corotron, not shown, charges the top surface of the overcoating 11 to a negative potential of between 400 and 800 volts. This causes toner to adhere to the paper to form an image on the copy, and is a basic step in the well known process of xerography. The base 13 is held at ground potential, so that a field is developed between the base and the overcoat. In reaction to this field, holes, shown as positive charges, migrate upward through the aluminum base 13 toward the selenium layer 12. If the surface of the selenium layer that is in contact with the base has a defect in the form of a selenium crystalite 22, then holes will enter the selenium layer and migrate in the presence of the electric field into the top portion of the selenium layer, as shown.

The second step is shown in FIG. 1*b* where some of the negative charges on the top surface of the overcoating 11 are attracted downward in reaction to the presence of the local positive charges in the top section of the selenium layer. When the transfer corotron is removed, the positive charges in the selenium and the negative charges in the overcoat will remain trapped in this position.

Figure 1D:
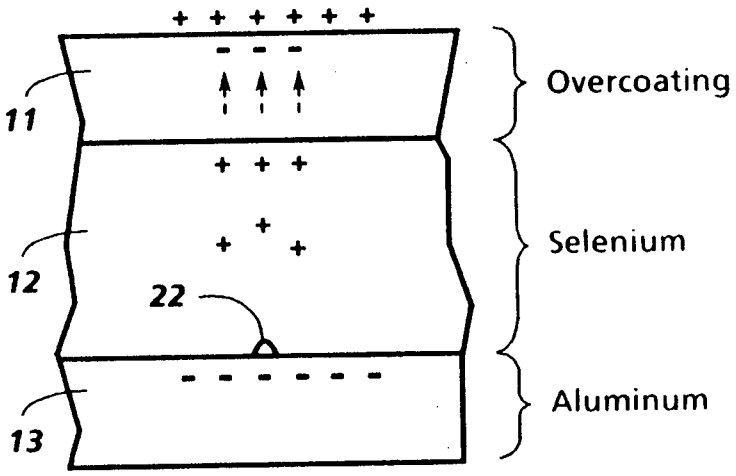
Figure 1C:
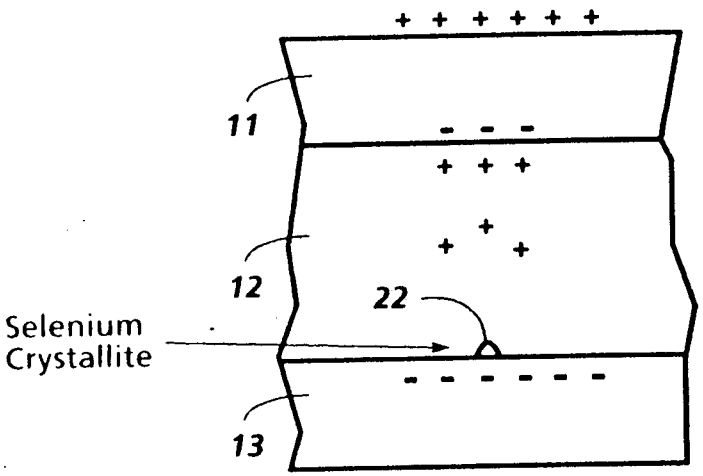

FIG. 1*c* shows the effect of the top surface being recharged through the use of a scorotron, not shown. The trapped charges remain.

FIG. 1*d* shows that, over time, the large charge on the top surface of the overcoat will attract the electrons in the bottom of the overcoat, which will conduct upward and neutralize some of the positive charges. The effect of this neutralization is to reduce the surface charge on the top of the overcoat at the point where the trapped negative charges had been. Now, with its top surface unevenly charged, the plate will produce images containing the artifact.

If the plate is stored in its recharged condition for a long period the holes will eventually recombine with the electrons and the plate can be used once without showing the defect. However, this detrapping process will occur following the first transfer step and the defect will re-appear on the second and subsequent cycles.

Figure 2:
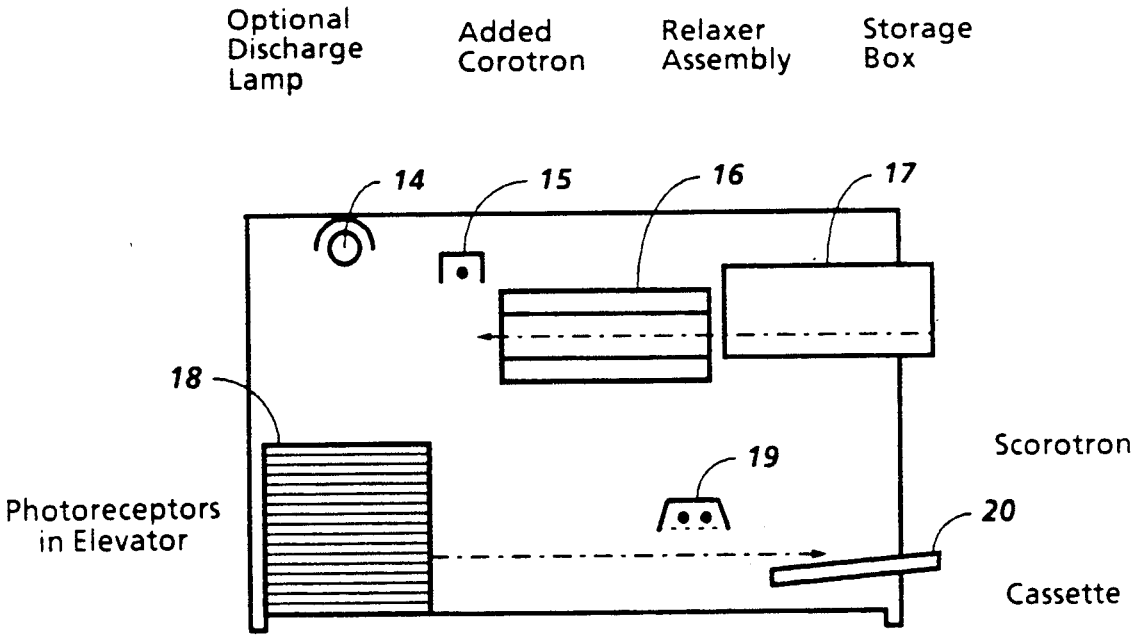
FIG. 2 is a diagram showing the location of the added charging corotron and discharge lamp.

FIG. 2 is a diagram of the preferred mechanism for preventing these artifacts and consists of a change in the development apparatus and process used in the x-ray imaging wherein the x-ray photoreceptor is precharged positively and then allowed to remain in that charged condition for a period of thirty seconds or more before the standard charging process. The used plates are brought to the conditioning system in the storage box 17 which is designed to hold 4 or 5 plates. The plates have just been through the image transfer station in the process or in order to transfer the x-ray image to the paper, and have also been discharged by an electro-luninescent strip, passed before a pre-clean corotron, cleaned of toner with a brush, and discharged with another electroluminiscent strip, before being inserted into the storage box. When the storage box 17 is inserted into its slot in the conditioner, each plate is automatically fed from the bottom of the box into the relaxer assembly 16 where it is kept for a relaxation cycle of typically 2½ minutes, and is then moved past the added corotron 15 in the upper plate path as shown in FIG. 2. The corotron 15 is located between the relaxer and the elevator and is energized as the photoreceptor leaves the relaxer and passes into the elevator. The photoreceptor is charged to approximately 1500 volts by the corotron and remains charged while in the elevator. An alternate variation of the invention is to discharge the photoreceptor with a light source 14 located over the elevator at the end of the relaxation cycle. A fluorescent light source such as the Sylvania "cool white" F14WT8 fourteen watt lamp or an incandescent source of similar wattage may be used. Although a discharge of the photoreceptor is not strictly necessary to eliminate fatigue, such a discharge may be desirable for other reasons such as minimization of dust accumulation on the charged selenium surface. The light discharge could be effected thirty seconds after the corotron pre-charging step, up to a maximum time determined by the positioning of the next photoreceptor over the photoreceptor to be discharged in the elevator.

The principle on which this invention operates is one of field induced detrapping of interface injected charge. Once the detrapping has been effected through the added pre-charging step, the photoreceptor is free of fatigue following the standard scorotron 19 charging step. Of course, when the protoreceptor passes through the transfer step it is once again charged negatively so that additional charge is injected through the interface which subsequently traps, so that the precharging step must be repeated every cycle.

While the invention has been described with reference to a specific embodiment, it will be understood by those skilled in the art that various changes may be made and equivalents may be substituted for elements thereof without departing from the true spirit and scope of the invention. In addition, many modifications may be made without departing from the essential teachings of the invention.

What is claimed is:

1. In a xerographic process comprising the steps of charging a xerographic selenium plate to a first voltage, exposing the plate to radiation, developing the plate with toner, transferring the toner image to the paper to create a copy, and cleaning the plate of toner before the next charging step, the additional steps between said cleaning step and said next charging step of:

precharging said plate to a second voltage of the same polarity as said first voltage, and waiting at least thirty seconds to release any trapped charges in said plate.

2. The process of claim 1 further comprising the step of using a light source to discharge the photoreceptor at least thirty seconds after said precharging step.

* * * * *